US007960711B1

(12) United States Patent
Sheehan et al.

(10) Patent No.: US 7,960,711 B1
(45) Date of Patent: Jun. 14, 2011

(54) FIELD-FREE ELECTROSPRAY NEBULIZER

(75) Inventors: Edward William Sheehan, Pittsburgh, PA (US); Ross Clark Willoughby, Pittsburgh, PA (US)

(73) Assignee: Chem-Space Associates, Inc., Pittsburgh, PA (US)

( * ) Notice: Subject to any disclaimer, the term of this patent is extended or adjusted under 35 U.S.C. 154(b) by 459 days.

(21) Appl. No.: 12/009,474

(22) Filed: Jan. 18, 2008

Related U.S. Application Data

(60) Provisional application No. 60/881,584, filed on Jan. 22, 2007.

(51) Int. Cl.
*H01J 49/00* (2006.01)

(52) U.S. Cl. ..... 250/493.1; 250/281; 250/282; 250/286; 250/503.1; 250/505.1

(58) Field of Classification Search ..... 250/281, 250/282, 283, 286, 288, 493.1, 503.1, 505.1
See application file for complete search history.

(56) References Cited

U.S. PATENT DOCUMENTS

| | | | | |
|---|---|---|---|---|
| 4,121,099 | A * | 10/1978 | French et al. | 250/296 |
| 4,209,696 | A * | 6/1980 | Fite | 250/281 |
| 4,318,028 | A | 3/1982 | Perel et al. | |
| 4,531,056 | A | 7/1985 | Labowsky et al. | |
| 5,306,910 | A | 4/1994 | Jarrell et al. | |
| 5,393,975 | A * | 2/1995 | Hail et al. | 250/288 |
| 5,838,002 | A | 11/1998 | Sheehan et al. | |
| 5,879,949 | A * | 3/1999 | Cole et al. | 436/173 |
| 6,147,345 | A | 11/2000 | Willoughby | |
| 6,278,111 | B1 | 8/2001 | Sheehan et al. | |
| 6,462,337 | B1 * | 10/2002 | Li et al. | 250/288 |
| 6,586,731 | B1 * | 7/2003 | Jolliffe | 250/288 |
| 6,888,132 | B1 * | 5/2005 | Sheehan et al. | 250/288 |

(Continued)

FOREIGN PATENT DOCUMENTS

GB 2428514 1/2007

(Continued)

OTHER PUBLICATIONS

Olivares, J.A., et al., "On-line mass spectrometric detection for capillary zone electrophoresis", Anal Chem 59, pp. 1230-1232 (1987).

(Continued)

*Primary Examiner* — Bernard E Souw
*Assistant Examiner* — Michael J Logie

(57) ABSTRACT

An improved electrospray ion source for increasing the current generated from the electrospray process and of the type having a needle (10), a counter-electrode (20), a saddle or outer electrode (30), and concurrent flow of gas (92). A method and device is disclosed that utilizes a controlled electrospray nebulizer where an aerosol comprised of charged droplets and gas-phase ions is sprayed into a field-free or near field-free desolvation or reaction region (120). This process results in the production and ultimate destination of charged aerosols and gas-phase ions in field-free or near field-free regions (120, 201, 210, 240, 340) where they can be directed towards and into a sampling aperture or tube; directed into a reaction region resulting in to the production of reaction products; or directed and deposited on surfaces resulting in the production of desorbed products by means of a concurrent flow of gas or nebulizing gas (92, 94, 96), a potential difference between the regions of production and destination, counter-current flow of gas, or a combination thereof. The method is useful for increasing the detection of analytes in solutions that are electrosprayed and analyzed with mass spectrometry.

22 Claims, 9 Drawing Sheets

U.S. PATENT DOCUMENTS

| | | | | |
|---|---|---|---|---|
| 6,949,741 | B2 | 9/2005 | Cody et al. | |
| 6,992,299 | B2 | 1/2006 | Lee et al. | |
| 6,998,605 | B1 | 2/2006 | Frazer et al. | |
| 7,015,466 | B2 * | 3/2006 | Takats et al. | 250/288 |
| 7,041,966 | B2 | 5/2006 | Frazer et al. | |
| 7,071,465 | B2 | 7/2006 | Hill, Jr. et al. | |
| 7,081,621 | B1 * | 7/2006 | Willoughby et al. | 250/288 |
| 7,095,019 | B1 | 8/2006 | Sheehan et al. | |
| 7,112,785 | B2 | 9/2006 | Laramee et al. | |
| 7,211,805 | B2 | 5/2007 | Kaga et al | |
| 7,253,406 | B1 | 8/2007 | Sheehan et al. | |
| 7,259,368 | B2 | 8/2007 | Frazer et al. | |
| 7,312,444 | B1 * | 12/2007 | Willougbhy et al. | 250/293 |
| 7,417,226 | B2 * | 8/2008 | Bajic et al. | 250/288 |
| 7,569,812 | B1 * | 8/2009 | Karpetsky et al. | 250/282 |
| 7,816,646 | B1 * | 10/2010 | Willoughby et al. | 250/288 |

FOREIGN PATENT DOCUMENTS

| | | |
|---|---|---|
| WO | WO 98/07505 | 2/1998 |
| WO | WO 03/010794 | 2/2003 |

OTHER PUBLICATIONS

Lee, T.D., et al., "An EHD source for the mass . . . ," Proceedings of the 36th ASMS Conference on Mass Spectrometry and Allied Topics, San Francisco, CA, Jun. 5-10, 1988.

Lee, T.D., et al., "Electrohydrodynamic emission mass . . . ," Proceedings of the 37th ASMS Conference on Mass Spectrometry and Allied Topics, Miami Beach, FL, May 21-26, 1989.

Mahoney, J.F., et al., "Electrohydrodynamic . . . ," Proceedings of the 38th ASMS Conference on Mass Conference on Mass Spectrometry and Allied Topics, Tucson, AR, Jun. 3-8, 1990.

Feng, X., et al., "Single isolated droplets with net charge as a source of ions," J Am Soc Mass Spectrom 11, pp. 393-399 (2000).

Schneider, B.B., et al., "An atmospheric pressure ion lens that improves nebulizer assisted electrospray ion sources," J Am Soc Mass Spectrom 13, pp. 906-913 (2002).

* cited by examiner

FIELD-FREE ELECTROSPRAY NEBULIZER

CROSS-REFERENCE TO RELATED APPLICATIONS

This application claims the benefit of Provisional Patent Application Ser. No. 60/881,584, filed Jan. 22, 2007 by the present inventors. This application is related to application Ser. No. 08/946,290, filed Oct. 7, 1997, now U.S. Pat. No. 6,147,345, granted Nov. 14, 2000; application Ser. No. 09/877,167, filed Jun. 8, 2001, now U.S. Pat. No. 6,744,041, granted Jun. 1, 2004; application Ser. No. 10/449,147, filed May 31, 2003, now U.S. Pat. No. 6,818,889, granted Nov. 16, 2004; application Ser. No. 10/449,344, filed May 1, 2003, now U.S Pat. No. 6,888,132, granted May 3, 2005; application Ser. No. 10/661,842, filed Sep. 12, 2003, now U.S. Pat. No. 6,949,740, granted Sep. 27, 2005; application Ser. No. 10/688,021, filed Oct. 17, 2003, now U.S. Pat. No. 6,943,347, granted Sep. 15, 2005; application Ser. No. 10/785,441, filed Feb. 23, 2004, now U.S. Pat. No. 6,878,930, granted Apr. 12, 2005; application Ser. No. 10/862,304, filed Jun. 7, 2004, now U.S. Pat. No. 7,087,898, granted Aug. 8, 2006, application Ser. No. 10/863,130, filed Jun. 7, 2004, now U.S. Pat. No. 6,914,243, granted Jul. 5, 2005; application Ser. No. 10/989,821, filed Nov. 25, 2004, now U.S. Pat. No. 7,081,621, granted Jul. 25, 2006; application Ser. No. 11/120,363, filed May 2, 2005, now U.S. Pat. No. 7,095,019, granted Aug. 22, 2006; application Ser. No. 11/173,377, filed Jun. 2, 2005, now U.S. Pat. No. 7,060,976, granted Jun. 13, 2006; application Ser. No. 11/491,634, filed Jul. 24, 2006, now U.S. Pat. No. 7,253,406, granted Aug. 7, 2007; and provisional application Ser. No. 60/724,399, filed Oct. 7, 2005.

GOVERNMENT SUPPORT

Not Applicable

SEQUENCE LISTING OR PROGRAM

Not Applicable

BACKGROUND

1. Field of Invention

This invention relates to methods and devices for improved electrospray nebulization and ionization, specifically to such electrospray nebulizers which are used for the production and introduction of gas-phase ions at atmospheric pressure into mass spectrometers and other gas-phase ion analyzers and detectors.

2. Discription of Prior Art

Ion sources that utilize high electrical potentials to generate ions at or near atmospheric pressure; such as, atmospheric pressure discharge ionization and chemical ionization, and electrospray ionization; have low sampling efficiency through conductance or transmission apertures, where less than 1% [often less than 1 ion in 10,000] of the ion current emanating from the ion source make it into the lower pressure regions of the present interfaces for mass spectrometry. Thereafter, scientists have devised several means of delivering and transferring gas-phase ions from atmospheric pressure sources into the vacuum system of mass spectrometers, such as, using lower flow electrostatic sprayers to form very small droplets [referred to as nanospray], using increased heating of the aerosols to generate more gas-phase ions, increasing the sampling diameter of the sampling aperture at the atmospheric-lower pressure interface, and using electrostatic, electrodynamic, or aerodynamic lens at atmospheric and low pressure to focus highly charged liquid jets, aerosols of droplets and ion clusters, and gas-phase ions.

Lens for Low Pressure Sources: Liquid Metal Ion and Low Pressure Electrospray Ion Sources Electrodes or lens have been disclosed to increase the ion signal of electrospray sources and liquid metal ion sources operated at lower pressures—for example, in U.S. Pat. No. 4,318,028 to Perel et al. (1982), Mahoney et al. (1987), Lee et al. (1988, 1989), and U.S. Pat. No. 7,211,805 to Kaga et al (2007). Our own patents U.S. Pat. Nos. 5,838,002 (1998), 6,278,111 B1 (2001), and World patent 98/07505 (1998) describes a sub-atmospheric source comprised of a concentric tube which surrounds the end of the electrospray capillary which was used to electrically stabilize the liquid cone-jet, directing the liquid jet into a heated high pressure region where the jet broke up into small droplets and where gas-phase ions and ion clusters were formed. This approach proved feasible but it was found to difficult to control the collection and focusing of ions formed in this higher-pressure region due to the electrical breakdown of the gases.

Lens for Atmospheric Pressure Electrospray Sources: Between Sprayer and Aperture or Inlet Several types of ring or planar electrodes positioned between the sprayer and an inlet aperture have been proposed to focus ions and charged droplets for example—Olivares et al. (1987) disclosed a focusing ring located downstream of the electrospray sprayer; U.S. Pat. No. 5,306,910 to Jarrell et al. (1994) disclosed a gird which is operated with an oscillating electrical potential to form gas-phase ions from highly charge droplets, while allowing the electrospray needle and entrance aperture to remain at ground potential, however, most of the droplets would impact on the grid as they pass through the grid, not making it into the inlet aperture; Feng et al. (2002) describes a series of annular electrodes downstream of an induction electrode used to guide charged droplets; Alousi et al. (2002) describes a lens between the electrospray needle and the entrance aperture dividing the ion source into two discrete areas, an area for the creation of highly charged droplets and gas-phase ions and a drift region with an electrical gradient across the area, leading to an increase of 2-10 fold in the signal intensity however, most of the ion current from the sprayer was deposited on the lens; and U.S. Pat. No. 7,071,465 to Hill, Jr. et al. (2006) disclosed placing the electrospray needle inside an ion mobility spectrometer comprised of a series of ring electrodes.

World patent 03/010794 A2 to Forssmann et al. (2003) disclosed a series of annular electrodes for ion acceleration and then subsequent ion focusing in front of the inlet aperture, similar to the device described by Jarrell et al. (1994). Jarrell et al.'s device utilize an oscillatory potential while Forssmann et al.'s device utilizes a direct current potential to first accelerate charged drops away from the electrospray needle, through an aperture in an accelerating electrode [or through an accelerating grid in Jarrell et al.'s device], and then into a focusing region. In both cases, droplets are accelerated away from an electrospray needle and travel up a potential gradient into a focusing region due to their momentum. Droplets and any gas-phase ions resulting from the breakup of the droplets would more than likely impact on the accelerating electrodes due to the diverging electrostatic fields along the axis of the electrodes.

Lens for Atmospheric Pressure Ion Sources: Lens at Electrospray Nebulizer and Discharge Source Several types of ring or planar electrodes at the sprayer have been proposed to focus ions and charged droplets at atmospheric pressure. U.S. Pat. No. 4,531,056 to Labowsky et al. (1985) disclosed a perforated diaphragm used to direct the flow of a gas over an electrospray needle to aid in the evaporation of highly charged droplets emanating from the needle and sweep away gas-phase solvent molecules from the area in front of the inlet aperture. In addition, the diaphragm was used to stabilize the position of the needle to direct the liquid jet through a center aperture in the diaphragm leading into a desolvation or ionization region.

For discharge ion sources, such as atmospheric pressure ionization of gases and atmospheric pressure chemical ionization, several types of lenses at the discharge source have been proposed and/or implemented—for example, U.S. Pat. No. 6,147,345 to Willoughby (2000) disclosed an electrospray ion source comprised of a discharge needle, a counter electrode, a lens, and a gas source for seeding the liquid emerging from an electrospray needle with counter ions; and U.S. Pat. No. 6,949,741 to Cody et al. (2005) and U.S. Pat. No. 7,112,785 to Larame et al. (2006), and now marketed as DART™ (Direct Analysis in Real Time) by JEOL-USA, Inc. (Peabody, Mass., www.jeol.com) and IONSENSE, Inc. (Peabody, Mass.; www.ionsense.com), disclosed an atmospheric discharge source comprised of a discharge needle, a counter electrode, and a field-free reaction chamber. Our own U.S. Pat. Nos. 6,888,132 (2005), 7,095,019 (2006), and 7,253,406 (2007), all to Sheehan et al. disclosed a remote reagent ion source comprised of a laminated high-transmission lens for ionizing gas-phase species in a field-free or near field-free reaction region; and U.S. provisional patent application 60/724,389 to Karpetsky et al. (2005) marketed and introduced for sale in June 2007 at the 55th ASMS Conference on Mass Spectrometry and Allied Topics (Indianapolis, Ind.), as Remote Reagent Ion Generator (RRIG) by Chem-Space Associates, Inc. (Pittsburgh, Pa.; www.lcms.com), disclosed a remote reagent chemical ionization source comprised of a discharge needle, counter electrode, and a saddle electrode coupled to a field-free transfer region for ionization of gas-phase species in a field-free or near field-free reaction region.

Several types of electrostatic lens or electrodes at the tip of the electrospray needle have been proposed, for example—Schneider et al. (2001, 2002) disclosed a ring shaped electrode incorporated near the tip of the electrospray needle which increased the detected ion signal and the stability of the signal and at the same time decreasing the dependence of the ion signal on the sprayer position; U.S. Pat. No. 7,067,804 to Chen et al. (2006) and G.B. patent application 2428514 to Syms (2007) both disclosed an individual lens and a series of lenses to shape the electric fields in the atmospheric pressure region to cause more ions from the source to reach a downstream ion detector; U.S. Pat. No. 6,462,337 to Li et al. (2002) disclosed an auxiliary electrode so as to increase the electric field gradient from the capillary to the inlet thereby focusing and decreasing the beam divergence; U.S. Pat. No. 6,992,299 to Lee et al. (2006) disclosed an aerodynamic ion focusing system that uses a high-velocity converging gas flow to focus a diverging aerosol ion plume; and U.S. Pat. No. 7,015,466 to Takats, et al. (2006) disclosed aerodynamic desolvation and focusing of the electrospray plume.

Two types of electrospray nebulizers with lens have been disclosed and are available for sale. An electrospray probe manufactured and sold by Thermo Scientific (San Jose, Calif.; www.thermo.com), H-ESI™ (Heated Electrospray Ionization) discloses aerodynamic desolvation and focusing using a supersonic flow of gas through a tube surrounding the electrospray needle. While U.S. Pat. Nos. 6,998,605 (2006), 7,041,966 (2006), 7,259,368 (2007), all to Frazer et al. disclosed an electrospray assembly at or near ground potential. The sample is introduced into the ionization chamber from an electrospray assembly at approximately ground potential. Two electrodes are provided within the chamber such that three electric fields are generated, a first field extending from the electrospray assembly to the first electrode, a second field extending from the second electrode to the first electrode, and a third field extending from the second electrode to the vacuum interface. Ionization takes place between the electrospray assembly and the second electrode. Ions are forces to travel through the three fields by a concurrent flow of gas and the electric fields generated by the electrodes and the vacuum interface, before entering the vacuum chamber. This design is incorporated into a multimode (electrospray and atmospheric pressure chemical ionization) source, G1978A™, offered by Agilent Technologies, Inc. (Santa Clara, Calif.; www.agient-.com).

Nevertheless atmospheric lens, electrodes, and grids in electrospray ion sources heretofore known suffer from a number of disadvantages:

(a) Electrospray nebulizers where lens and electrodes are disposed in the ionization region where gas-phase ions are formed from charged droplets, droplets and ion-clusters are lost due to impaction on these structures.

(b) The use of lenses in the ionization region to focus ions and charged droplets leads to the dispersion of these ions as they past through each subsequent lens, such as the dispersion at the entrance to capillary tubes or apertures. Ions, droplets, and ion-clusters can be lost due to these dispersive forces.

(c) The use of multiple lenses in the ionization region requires the use of greater and greater potentials on the lens to focus the ions from one region to another. This creates a large electrostatic gradient across the ionization region which can lead to possible electrostatic breakdown of the gases in the region, the requirement for high voltage power supplies, and dispersive loses as the ions pass through the lens. In essence, the more you try to focus ions with larger potentials the more they will disperse as they leave the area of large potentials and enter areas of lower or no potentials, such as passing through an aperture or into a tube.

(d) If one uses high velocity flows of gas to focus ions there is a need for a large volume of gas and since larger droplets are influences more so than smaller droplets and gas-phase ions by these viscous forces, larger droplets are lost due to impaction on lens and walls of the ionization chamber and are thereby lost from the gas-phase ion production process.

OBJECTS AND ADVANTAGES

Accordingly several objects and advantages of the present invention are:

(a) to provide an electrospray nebulizer which will present a field-free or near field-free desolvation and ionization region for collecting and focusing charged droplets or gas-phase ions resulting from the desolvation process;

(b) to provide an electrospray nebulizer which will present a field-free or near field-free desolvation region where downstream electrostatic lens can compress the charged species, gas-phase ions, charged droplets, ion-clusters, etc., into a small cross-sectional area without the potentials of the ion source influencing the movement of the charged species;

(c) to provide an electrospray nebulizer which will present a field-free or near field-free region 100's of $cm^3$ in volume;

(d) to provide an electrospray nebulizer which will present a field-free or near field-free desolvation region where viscous forces can dominate the movement of gas-phase charged species, such as gas-phase ions, charged droplets, ion-clusters, etc.;

(e) to provide an electrospray nebulizer which will present a field-free or near field-free region for reacting charged droplets with gas-phase ions or aerosols of charged or neutral species, forming new charged species which can then be sampled by a gas-phase ion focusing device or analyzer, such as but not limited to, AC focusing devices, ion mobility, differential mobility, or mass spectrometers, etc.;

(f) to provide an electrospray nebulizer which will present a field-free or near field-free region where neutrals and charged droplets or gas-phase ions can reside for prolong periods of time allowing reactions between these species to occur over long periods of time;

(g) to provide an electrospray nebulizer which will present a field-free or near field-free region where the position of the nebulizer relative to the ion detector is not critical and independent of each other;

(h) to provide an electrospray nebulizer which will present an array of electrospray nebulizers to a single or multiple field-free regions;

(i) to provide an electrospray nebulizer which is independent of electrospray ion source type, such as but not limited to, nanospray, pneumatically assisted electrospray, etc.;

(j) to provide an electrospray nebulizer which will present a gas flowing between the electrospray needle and counter-electrode to aid in the production of a highly charged aerosol of charged droplets and then subsequently sweeping this highly charged aerosol into a field-free or near field-free region;

(k) to provide an electrospray nebulizer which will present a decoupling of the processes required for electrospraying a liquid, such as electrical potential, the magnitude of gas flow and temperature of the nebulizing gas, etc.; from the processes needed for ion evaporation, ion desorption, ion collection, focusing, and transport of ions into the vacuum chamber of a mass spectrometer;

(l) to provide an electrospray nebulizer which can be used to deposit charged droplets onto a surface in a field-free or near field-free region for the purpose of charging-up the surface or charging and subsequently ionizing any chemical species contained on the surface;

(m) to provide an electrospray nebulizer that can be incorporated along with a field-free or near field-free reaction or desolvation chamber, gases, electronics, controller, high voltage supplies, and gas-phase ion detector into a portable or benchtop chemical analyzer; and (n) to provide an a chemical analyzer which will present the processes required for analyzing components on a surface by delivering charged droplets to the surface in a field-free or near field-free region, collecting ionized products, and subsequently identifying surface components; by controlling the production and transport of the highly charged aerosol of droplets to the surface.

Further objects and advantages are to provide a field-free electrospray nebulizer which can be used easily and conveniently to generate charged particles or droplets, which is inexpensive to manufacture, which can be supplied in a variety of configurations to accommodate liquid flows of several microliters to hundreds of microliters, which can be manufactured as a small probe the size of one's finger or as a larger assembly depending on the application; where the outside of the nebulizer is at ground potential, thereby allowing the probe to be handled without the risk of an electric shock; which can easily replace existing nebulizers; etc. Still further objects and advantages will become apparent from a consideration of the ensuing description and drawings.

SUMMARY

In accordance with the present invention a field-free electrospray nebulizer comprises a needle or capillary for delivering a liquid, a counter-electrode, a saddle electrode, and a concurrent flow of gas; for introducing charged droplets into a field-free region. The novelty of this device is the manner in which the charged droplets or aerosols in a field-free region are both physically and electrically isolated from the high electric fields of the aerosol or charged droplet generation region. This is accomplished through the utilization of a saddle electrode.

DRAWINGS FIGURES

In the drawings, closely related figures have the same number but different alphabetic suffixes.

Figure 4A:
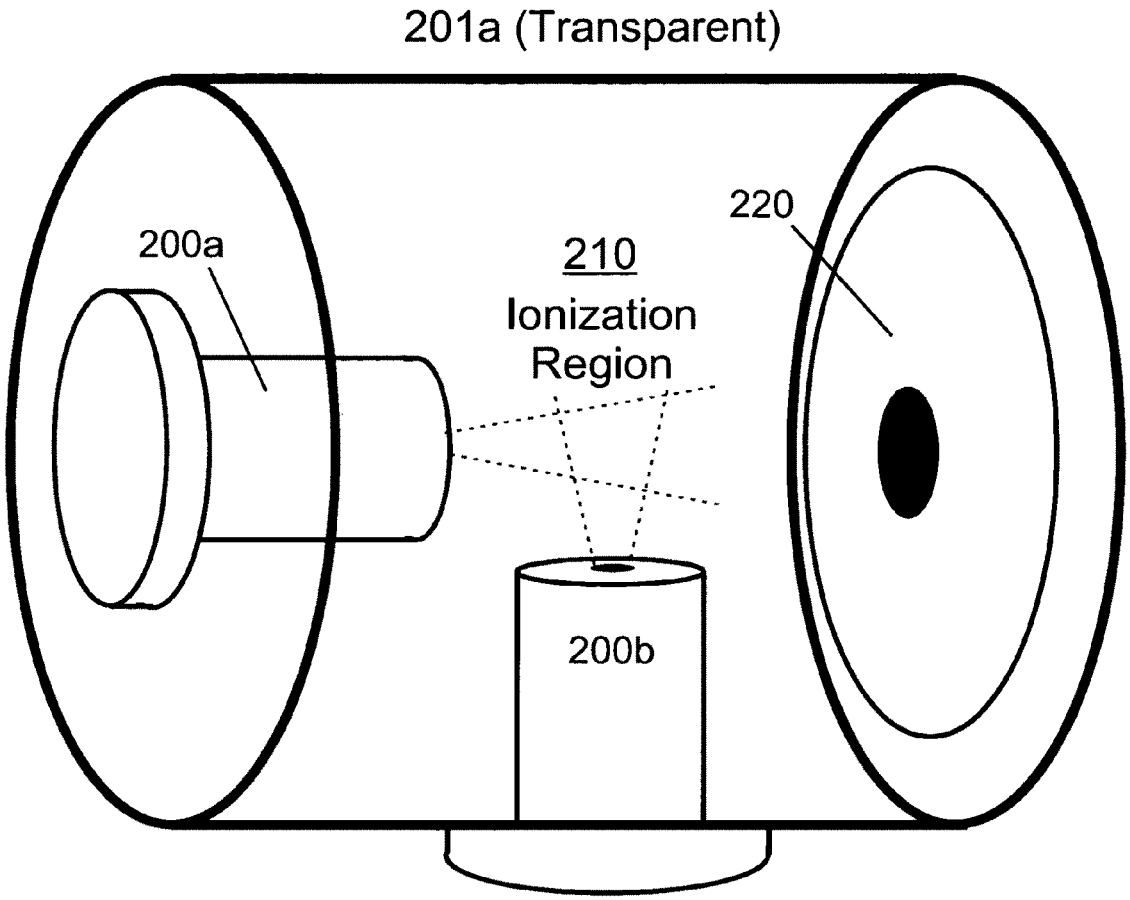
Figure 4B:
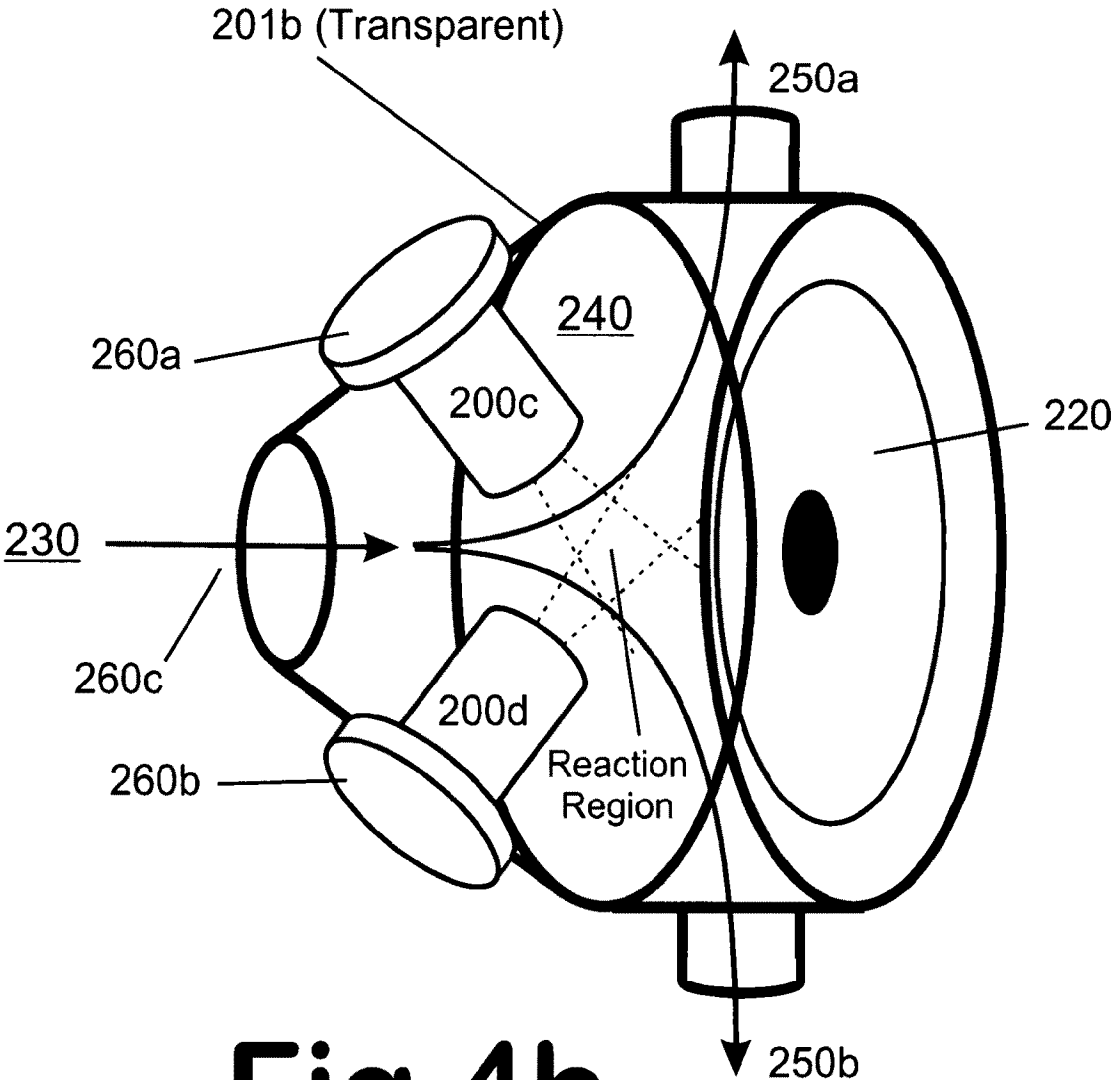

FIGS. 4*a* and 4*b* shows perspective cut-aways of field-free electrospray nebulizers incorporated into an atmospheric desolvation/ionization or reaction chamber: 4*a*, showing the nebulizer configured on-axis and orthogonal with an emersion lens and funnel-well; and 4*b*, shows two nebulizers incorporated into a reaction chamber with a sample inlet and ion optics.

Figure 5:
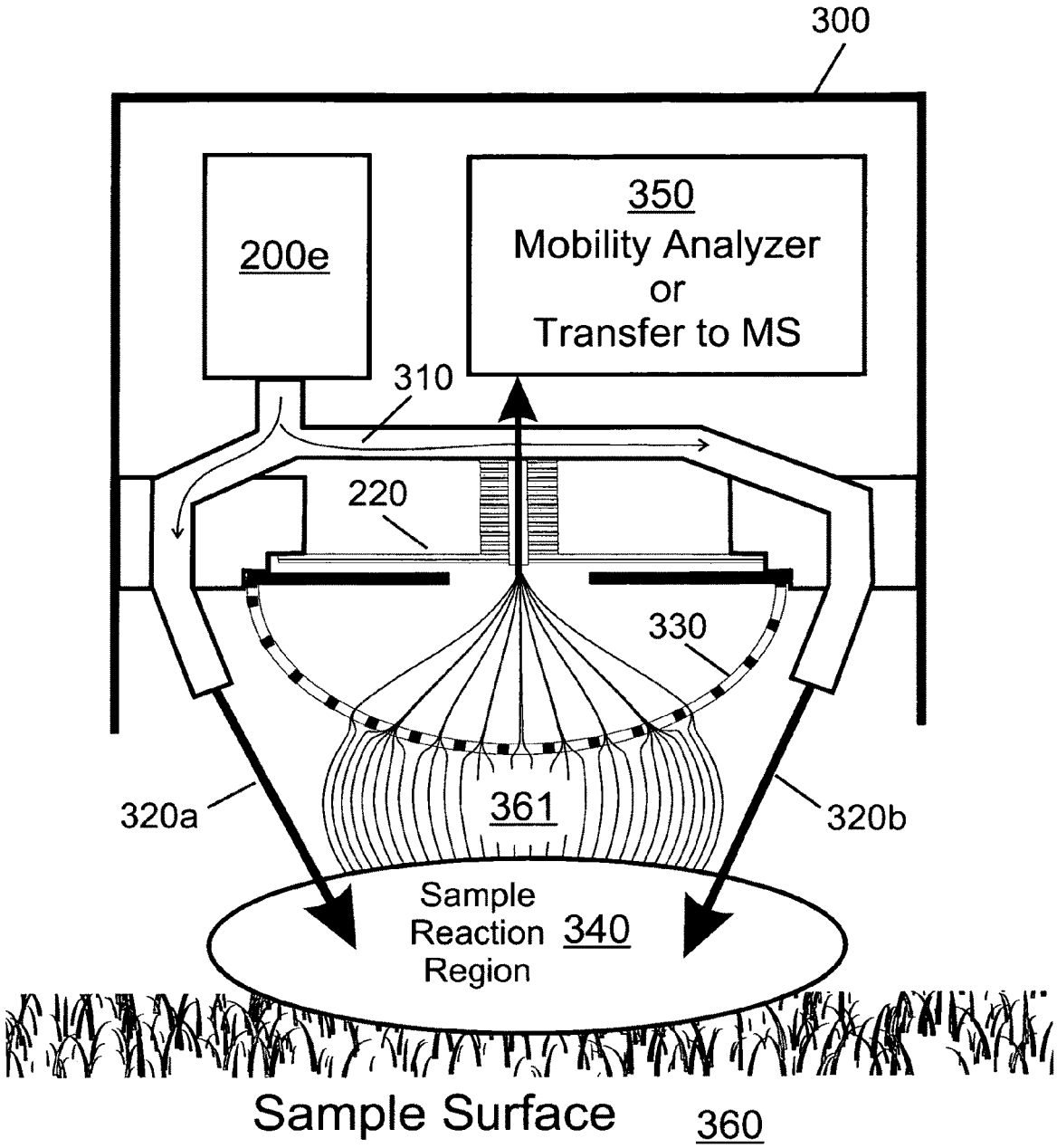

FIG. 5 shows a perspective cut-away of a surface ionization and detection device.

Figure 6A:
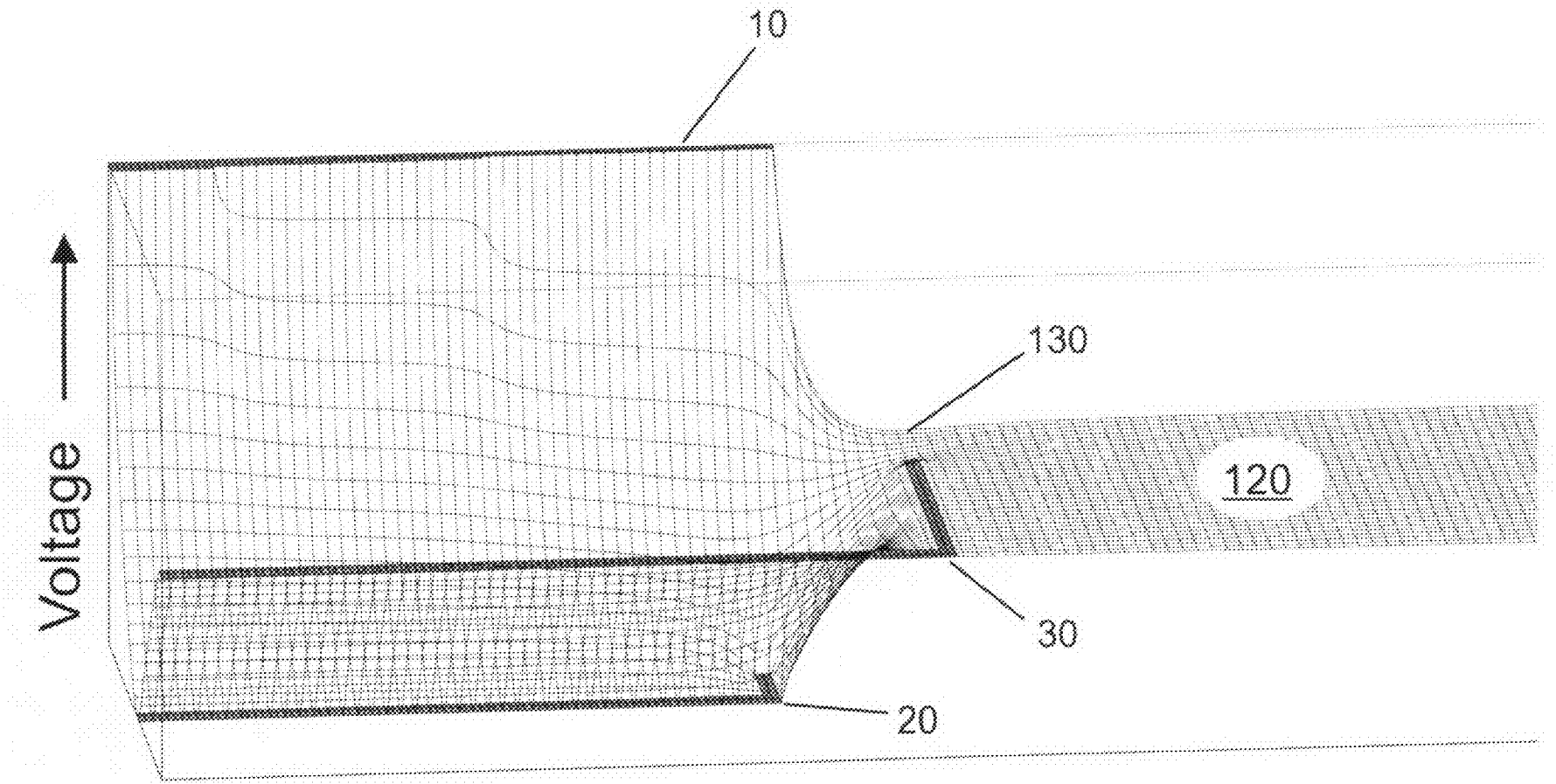

FIGS. 6*a* (side view), 6*b* (front view), and 6*c* (top view) show bilateral views of the equipotential surfaces of the electrospray nebulizer, illustrating the relative potentials of the needle, counter-electrode, and saddle electrode; and the open ended saddle-field region flaring out into a field-free or near field free region.

DRAWING

Reference Numbers

10 electrospray needle or capillary
12 electrohydrodynamic spray
13 inner tube or capillary
14 co-axial tube
20 counter-electrode or inner electrode
22 aperture or passage
30 saddle or outer electrode
32 aperture or passage
40 insulated transfer tube
60 connector flange
70 liquid connectors
80 liquid sample inlet
90 gas-inlet
92 concurrent flow gases
94 concurrent gas
96 nebulizing gas
100 high-voltage feed-through
102 high-voltage connection
104 high-voltage connecting wire
110 insulator
120 field-free or near field-free region
130 open ended saddle-field region
200 nebulizer
201 chamber
210 desolvation/ionization region
220 ion optics assembly

230 sample inlet
240 desolvation/ionization-reaction region
250 exhaust
260 x, y, z adjustment stages
300 grounded housing
310 transfer tubing
320 aerosol beam
330 high-transmission element (HTE)
340 field-free or near field-free region
350 gas-phase ion detector
360 surface
361 gas-phase ions or charged droplets

DESCRIPTION

Figure 1:
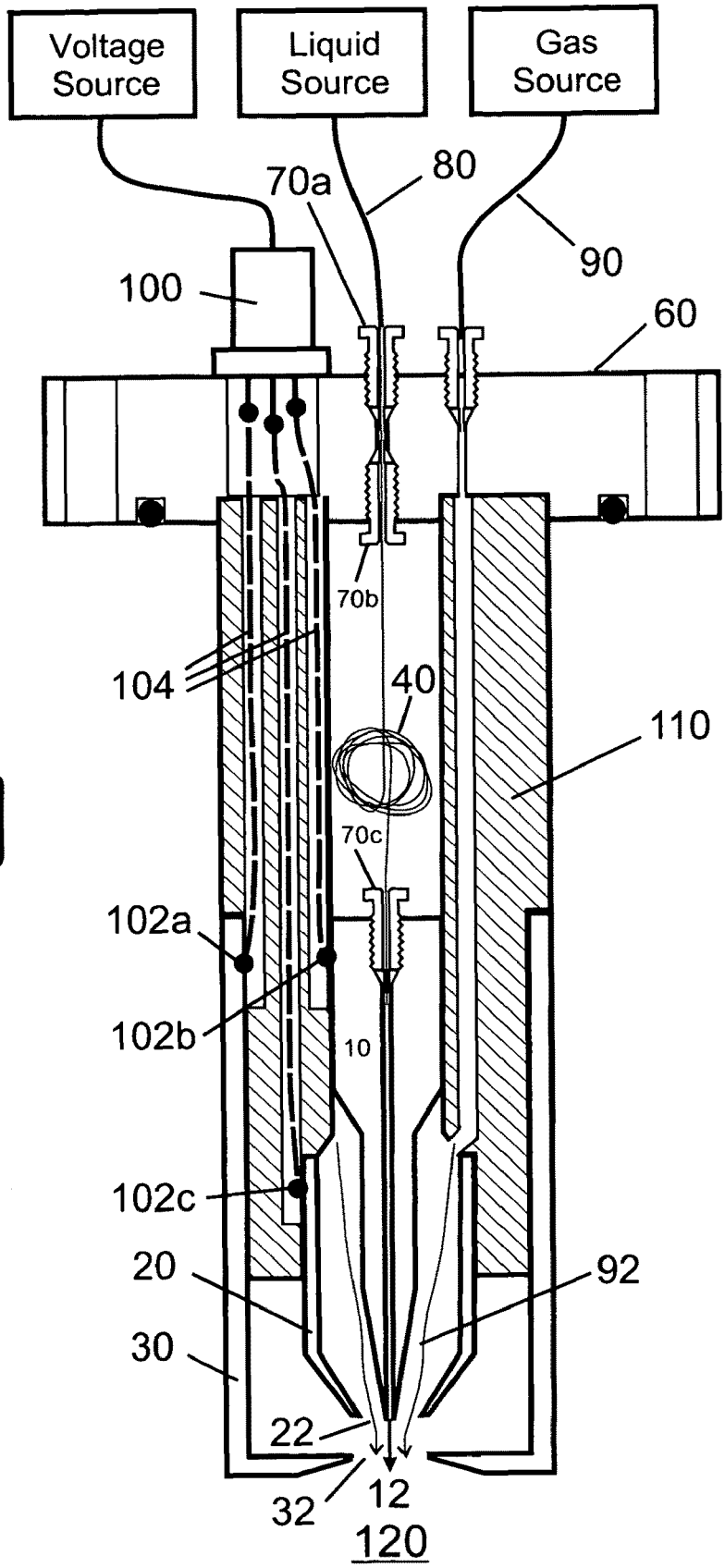
FIG. 1 shows a cross-sectional view of a field-free electrospray nebulizer.

FIGS. 1 and 6—Preferred Embodiment

The present invention may be used to generate electrospray aerosols in a field-free or near field-free region with higher total spray current and higher gas-phase ion production efficiency in order to detect a wide variety of ionized analytes in solution. Typical solvents include, but are not limited to water, methanol, isopropyl alcohol, ethanol, acetonitrile or solutions containing some or all of the mentioned solvents; delivered to the nebulizer from a liquid source, such as but not limited to, a high-performance liquid chromatograph (HPLC). Typical analytes are drugs and their metabolites or degradation products, biopolymers, metals, or any ionic species soluble in the solvents or mixtures of the solvents. Preferred liquid flow rates for the electrospray process are from 0.05 to 200 micro-liters per minute but may be as low as 0.001 micro-liters per minute, commonly referred to as nanospray.

A preferred embodiment of the present invention is a field-free electrospray nebulizer assembly or just nebulizer as illustrated in FIG. 1. The nebulizer is comprised of an electrospray needle or capillary 10, a counter-electrode or inner electrode 20, a saddle or outer electrode 30, a connector flange 60, liquid connectors 70*a*, 70*b*, 70*c* for connecting or joining tubing, liquid sample inlet 80, gas-inlet 90, and high-voltage feed-through 100. The needle 10 is connected to the downstream end of an insulated transfer tube 40, which electrically isolates the needle 10 from the connector flange 60. The electrospray needle 10, counter-electrode 20, and saddle electrode 30 are made of electrically conductive materials, such as but not limited to stainless steel, etc. While the connectors 70 can be made of electrically conductive or insulating material.

Co-axial to and surrounding the needle is the counter-electrode 20 while the saddle electrode 30 is co-axial and downstream of both the needle 10 and counter-electrode 20. Both the counter-electrode 20 and the saddle electrode 30 have passages or apertures 22, 32. Insulator 110 isolates needle 10, counter-electrode 20, and saddle electrode 30 from each other.

Voltage power supplies (shown as Voltage Source) are connected to the electrospray needle 10, the counter-electrode 20, and saddle electrode 30 at high-voltage connections 102*a*, 102*b*, 102*c* through a high-voltage connecting wires 104. For the electrospray needle 10 the high voltage connection is made through either direct contact with the needle 10, in the case where the capillary 10 is a conductor; or alternatively the electrospray needle 10 may be made of insulating material, such as but limited to fused silica, glass, PEEK, etc; in which case the high-voltage connection can be made through the connector flange 60, or the transfer tube 40 which would be further comprised of an insulated tube and a metal tube. Electrical potentials are established to produce an electrohydrodynamic spray 12 at the outlet of the needle 10 and to establish an open ended saddle-field region 130 flaring out into a field-free or near field-free region 120.

The needle 10 is typically 0.5 to 3 mm in diameter (outside diameter) tapering to a point or tip. The counter-electrode 20 and saddle electrode 30 are 0.5 to 2 mm thick with the apertures 22, 32 configured as circular-shaped openings typically 0.5 to 1 mm in diameter. In other embodiments, the geometry of the apertures 22, 32 can be, but are not limited to, slotted, rectangular, diamond, or trapezoidal shapes, etc.; and the thickness of the electrodes 20, 30 can also vary depending on the particular gases used, shape of the needle 10, flow of the liquid, etc.

All components of the device are generally made of chemically inert materials. The needle 10, counter-electrode 20, saddle electrode 30, connector flange 60, and wiring are comprised of conductive materials, such as stainless steel, brass, copper, gold, or aluminum. Circular electric insulator 110, electrically isolate metal layers, respectively.

Gas or mixtures of concurrent flow gases 92 are supplied to the nebulizer and flow (along with the liquid) between the needle 10 and the counter-electrode 20 downstream towards and through the saddle electrode 30 out into the field-free or near field-free region 120. Gases are supplied to the nebulizer from metered gas reservoirs (shown as Gas Source) through a gas in-let 90. Gases or gas mixtures, such as but not limited to nitrogen or air can be used.

FIGS. 2, 3, 4*a*, and 4*b*—Additional Embodiments

Additional embodiments are shown in FIGS. 2, 3, 4*a*, and 4*b*.

Adding Concurrent Gas Flow

Figure 2:
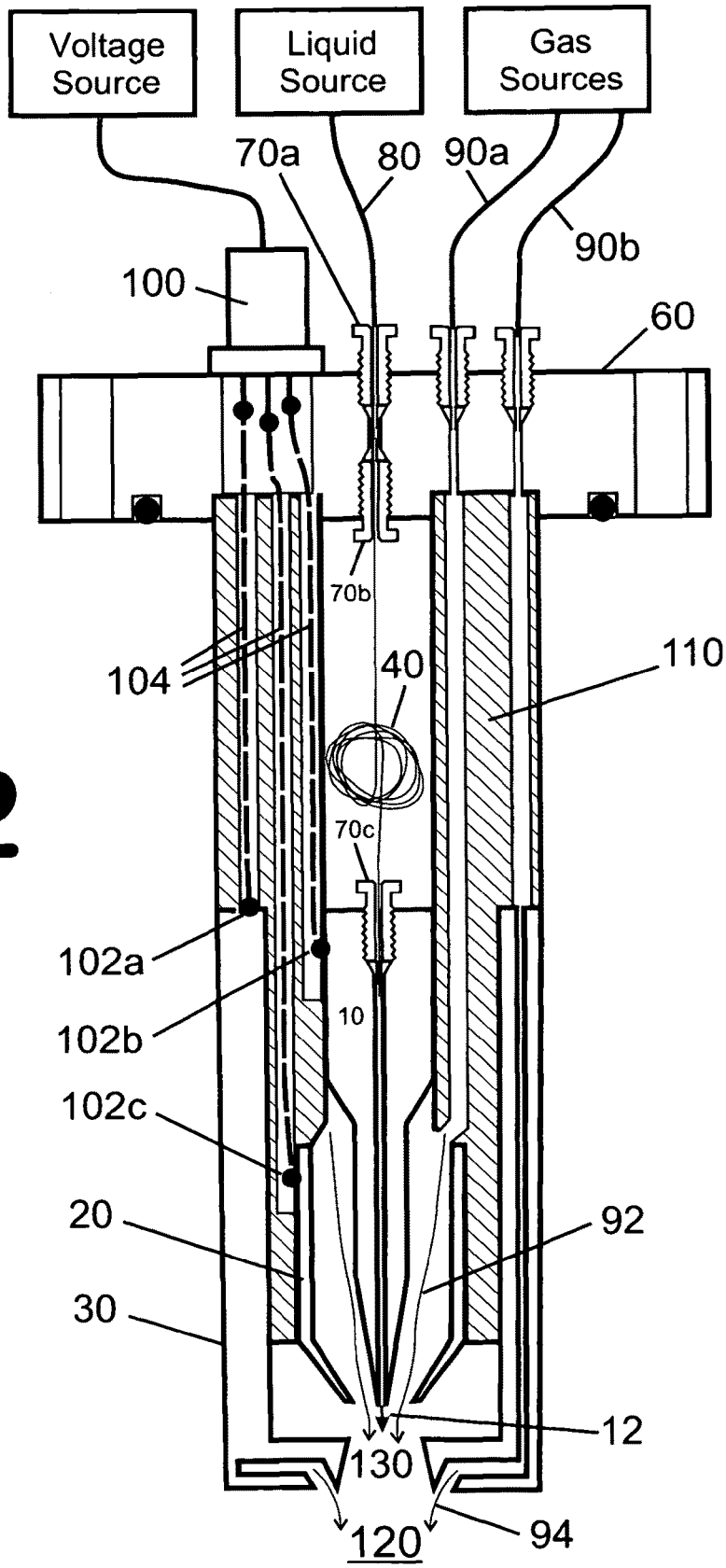
FIG. 2 show a similar view of the field-free electrospray nebulizer with an additional concurrent flow of gas incorporated into the nebulizer.

FIG. 2 shows a modified saddle electrode 30 for adding additional gas into the field-free region 120. A second supply of gas 94 is supplied and flows through an opening or a series of openings and out into the filed-free region 120. The concurrent gas 94 may be comprised of nitrogen, air, gas mixtures, heated gas, etc. to aide in the evaporation of the aerosol, gas saturated with solvent vapor to suppress evaporation, or combination thereof. The flow or velocity of gas 94 may be slower than the flow of the aerosol emerging from aperture 32, the same speed so as to establish iso-kinetic flow downstream of the saddle electrode 30, or faster so as to cause more extensive mixing of the aerosol with the drying gas and also to impart a directionality to the total flow of gas and aerosol.

Pneumatically Assisted Electrospray

Figure 3:
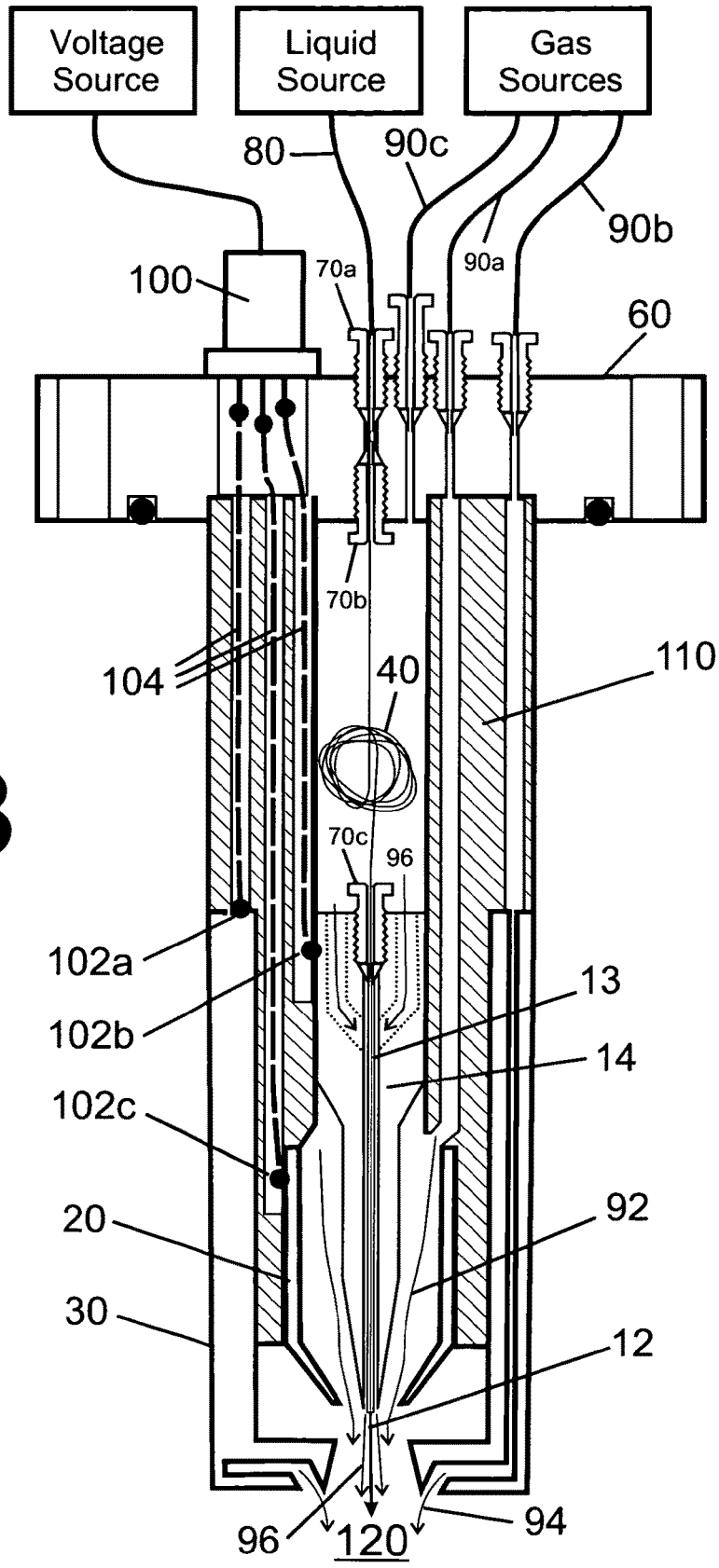
FIG. 3 show a similar field-free electrospray nebulizer configured as a pneumatically assisted electrospray nebulizer.

FIG. 3 shows an electrospray needle comprised of an inner tube or capillary 13 and on co-axial tube 14. Nebulizing gas 96 is supplied between these tubes to aid the electrospray process.

Field-Free Nebulizer Desolation Assembly Incorporated into an Atmospheric or Near Atmospheric Desolvation/Ionization Chamber and a Reaction Chamber FIG. 4*a* shows the nebulizer 200*a* incorporated into an atmospheric or near atmospheric cylindrical desolvation/ionization chamber 201*a* with the nebulizer positioned on-axis 200*a* or alternatively orthogonal 200*b* to an ion optics assembly 220. The chamber 201*a* encloses a desolvation/ionization region 210. Where the ion optics assembly 220 can be comprised of, but limited to, an emersion lens; an atmospheric pressure interface comprised of skimmers, metal or glass tubes, or arrays of tubes leading into a vacuum chamber occupied by a mass spectrometer; other low pressure ion optic components, such as, lens and radio-frequency (RF) ion guide; atmospheric or near atmospheric ion optics such as high-transmission elements or lens as described in our U.S. Pat. Nos. 6,744,041 (2004), 6,818,889 (2004), and 7,081,621

(2006); a laminated lens as described in our U.S. Pat. No. 6,949,740 (2005); a laminated tube or arrays of laminated tubes as described in our U.S. Pat. No. 6,943,347 (2005); ion selective aperture arrays as described in our U.S. Pat. Nos. 6,914,243 (2005) and 7,060,976 (2006); radio-frequency (RF) devices as described in our U.S. Pat. Nos. 6,784,424 (2004) 7,312,444 (2007); or combinations thereof.

FIG. 4*b* show two nebulizers 200*c*, 200*d*, but not limited to two, incorporated into a similar chamber where the chamber 201*b* is used as a desolvation/ionization chamber or a reaction chamber as described in our previous U.S. Pat. Nos. 6,878,930 (2005), 6,888,132 (2005), 7,087,898 (2006), 7,095,019 (2006), and 7,253,406 (2006). In addition, the chamber 201*b* is comprised of a sample inlet 230; a desolvation/ionization-reaction region 240 where gas-phase ions or highly charged aerosols from the nebulizers 200*c*, 200*d* reacts with gas-phase neutral molecules, ionic or highly charged aerosol components introduced into the chamber 201*b* from the sample inlet 230; an exhaust 250*a*, 250*b* where excess gases can be removed from the chamber 201*b*; and x,y,z adjustment stages 260*a*, 260*b*, 260*c* for adjusting the position of both nebulizers 200*c*, 200*d* and sample inlet 230, respectively. The sample inlet 230 can be comprised of, but not limited to, an electrospray nebulizer; remote ion sources as describe in our U.S Pat. Nos. 6,888,132 (2005), 7,095,019 (2006), and 7,253,406 (2007), and provisional patent 60/724,399 (2005); a nebulizer as described in the preferred embodiment above; transfer tube from a gas chromatograph; a heated liquid inlet as part of an HPLC system, such as a thermospray nebulizer or an APCI (atmospheric pressure chemical ionization) nebulizer; a probe, such as a solid samples probe which can be heated, a desorption probe, or a MALDI target where the sample is desorbed by means of directing photons onto the sample; the outlet of a collector of gas-phase neutral or ionic molecules or particles; atmospheric or near atmospheric pressure ion optics as describe in our U.S. Pat. Nos. 6,744,041 (2004), 6,784,424 (2004), 6,818,889 (2004), 6,914,243 (2005), 6,943,347 (2005), 6,949,740 (2005), 7,060,976 (2006). 7,081,621 (2006), 7,312,444 (2007); and combinations thereof. Additional gases may be added to the chamber 201*b* through inlet 230 or other inlets attached to the chamber 201*b* which are directed to intersect the flow of the aerosol emerging from the nebulizer 200*c*, 200*d* to aide in the further evaporation of the aerosol producing gas-phase ions, such as helium, heated or unheated; or reactive gases, such as metastable helium, oxygen, which can react with the particles or droplets in the aerosol producing charged reactant products. In both situations, the gas-phase ions and charged reactant products can be sampled and focused with the ion optics 220.

Chambers 201*a*, 201*b* can be heated by any conventional means, such as but not limited to a cartridge heater (not shown). The temperature of the chambers 201*a*, 201*b* and therefore the region enclosed within the chambers, can be regulated by means of a thermocouple (not shown) attached to the chamber; with the thermocouple and cartridge heater coupled to a temperature controller to adjust the heater power to maintain the desired temperature. Alternatively, the chambers, 201*a*, 201*b* and respective regions 210, 240 can be heated by heating the gas flowing into the region from the nebulizers 200*a*, 200*b*, 200*c*, 200*d*, the sample inlet 230, ion optics assembly 220, or combinations thereof.

FIG. 5—Alternate Embodiment (Surface Ionization and Detector)

There are various possibilities with regard to configuring the nebulizer for ionizing components on surfaces and subsequently collecting and detecting the components. FIG. 5 illustrates an embodiment of a surface ionization device that can be portable or stationary comprised of the nebulizer 200*e*, a grounded housing 300, transfer tubing 310 for directing a highly charged aerosol beam 320*a*, 320*b* comprised of liquid droplets to a surface 360, collection optics comprised of a high-transmission element (HTE) 330 and ion optics assembly 230*b* (as disclosed in our U.S. Pat. Nos. 6,744,041 (2004), 6,818,998 (2004), 6,914,243 (005), 6,940,740 (2005), 6,943,347 (2005), 7,081,621 (2005), and 7,060,976 (2006)) for collecting, focusing, and delivering gas-phase ions or charged droplets 361 resulting from the highly charged aerosol reacting with a sample or samples on the surface 360; a field-free or near field-free region 340 sandwiched between the surface 360 and the HTE 330; and a gas-phase ion detector 350 such as but not limited, to a mobility analyzer (ion mobility spectrometer or a differential ion mobility spectrometer); an ion detector in a vacuum chamber comprised of an atmospheric pressure interface to the vacuum chamber, a mass spectrometer (MS); or combinations thereof.

OPERATION

FIGS. 1 thru 6

Figure 6B:
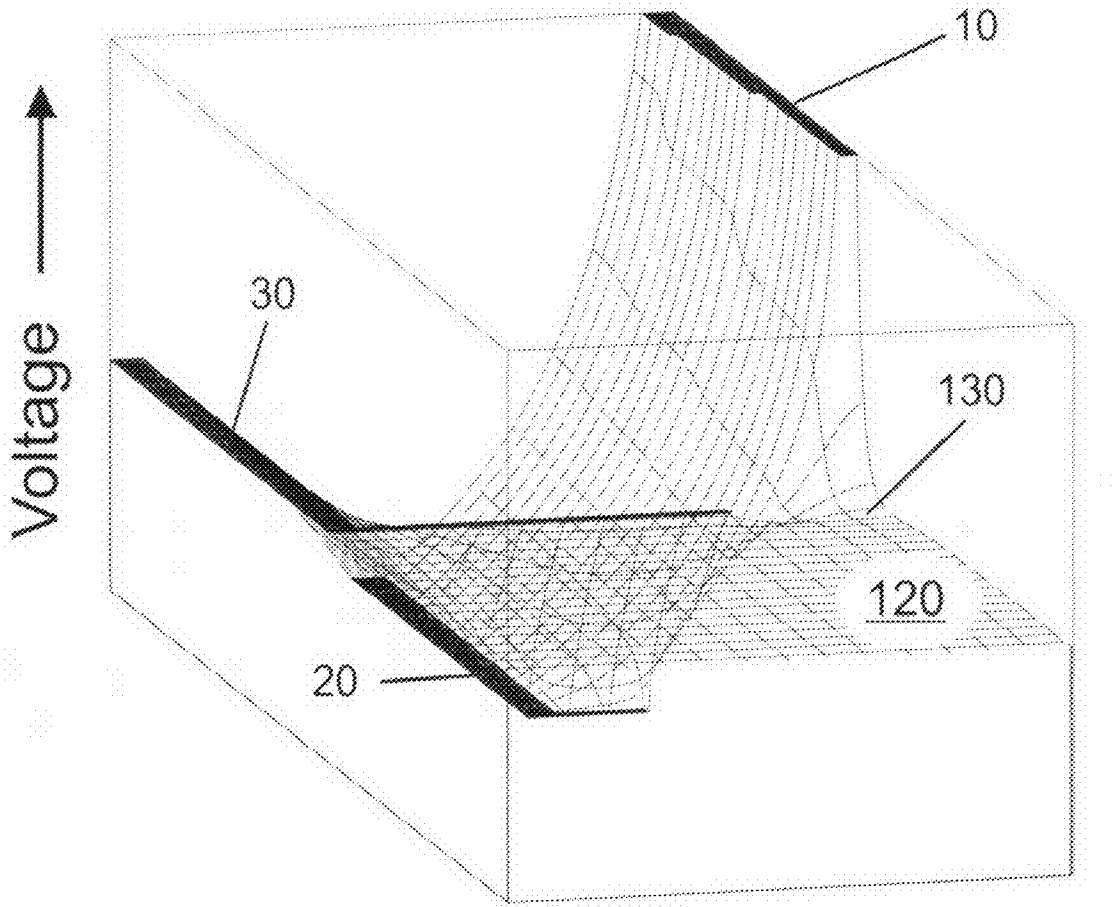
Figure 6C:
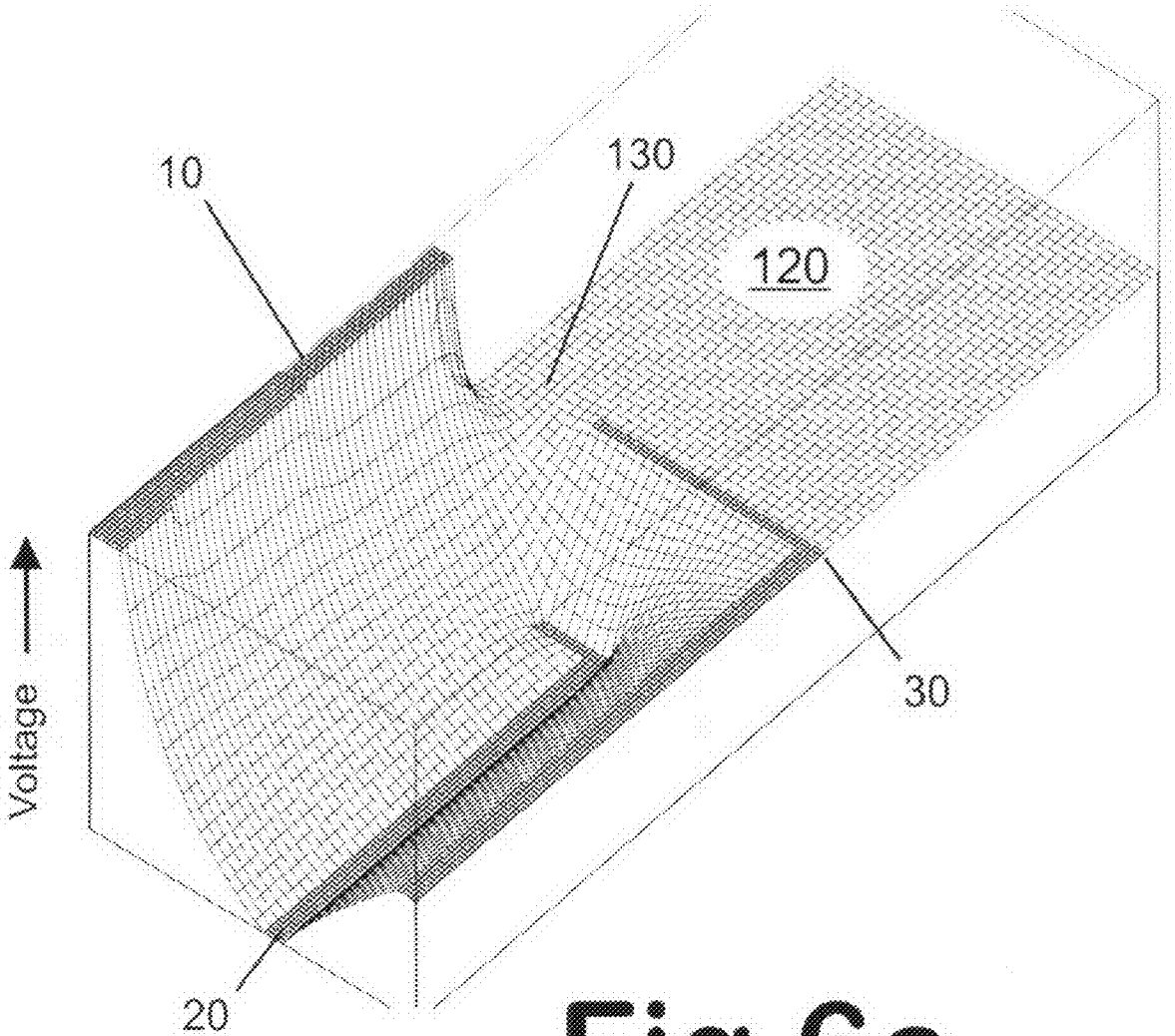

The nebulizer is operated as a field-free or near field-free electrospray nebulizer for liquid chromatography analysis by establishing a DC potential difference between the needle 10 and the counter-electrode 20. A liquid solution from the sample inlet 80 is pumped through the tube 40 into the needle 10. As the liquid exits the needle it forms an electrohydrodynamic spray 12 or a liquid cone-jet geometry at the outlet of the capillary. The highly-charged aerosol resulting from the electrospray nebulizing/ionization process and the gas 92 flowing between the needle 10 and the counter-electrode 20 are directed into the aperture 32 in the saddle electrode 30. By also establishing a DC potential on the saddle electrode 30 that is greater then the potential on the counter-electrode 20 but less than the potential on the needle 10, region 120 is maintained field-free or near field-free, as shown in FIGS. 6*a* thru 6*c*.

For example, the needle 10 may have a potential of +2,500 volts while the counter-electrode 20, saddle electrode 30, and walls enclosing the field-free or near field-free region 120 are at −2,500, ~0, and ~0 volts, respectively. This results in a highly charge aerosol of positive droplets being propelled by electrostatic and viscous forces into the field-free region 120. Other operating parameters are possible, the needle 10 can be ~0 volts, the counter-electrode 20 −5,000 volts, and saddle electrode 30 and walls −2,500 volts resulting a highly charged aerosol of positive ions; or the needle 10 ~0 volts, the counter-electrode 20 +5,000 volts, and saddle electrode and walls 30 +2,500 volts resulting in a highly charged aerosol of negative ions. In each situation region 120 is maintain field-free or near field-free.

The evaporation of the aerosol may be further enhanced by adding gasses to the field-free or near field-free region 120, desolvation/ionization region 210, or combinations thereof. Any resulting gas-phase ions being produced from the electrospray or pneumatically assisted electrospray process can be sampled and focused with ion optics 220 and introduced into an atmospheric interface to a mass spectrometer.

Alternatively, as shown in FIG. 4*b*, the aerosol may be directed into reaction region 240 resulting in the production of reaction products; or as shown in FIG. 5, the high-charged aerosol flowing out of the nebulizer may be directed onto the surface 360 where components on the surface may desorbed off as described in U.S. patent publication 2005/0230635 (2005) entitled "Method and system for desorption electrospray ionization". But unlike publication 2005/0230635 where the process of deposition and desorption is performed in a region with highly dispersive electrostatic fields, here the electrospray aerosol is deposited and ions are desorbed in a field-free region 340.

ADVANTAGES

From the description above, a number of advantages of our field-free electrospray nebulizer become evident:

(a) The presence of a saddle electrode will permit charged droplets and gas-phase ions resulting from the electrospray process to pass through the saddle electrode without impacting on the electrode and reside in a field-free or near field-free region.

(b) The use of a saddle electrode will provide a field-free or near field-free region downstream of the electrospray nebulizer where the dispersive forces of the ion source are minimal.

(c) The use of a saddle electrode will permit the use of low electrical potential optics in the field-free or near field-free region, thus avoiding the need for high electrical potentials to focus and collect charged species.

(d) With a saddle electrode, one can add various gases to the field-free or near field-free region for drying droplets, thus avoiding the possible breakdown of these gases that occur in the high electric fields of the electrospray nebulizer.

(e) The use of the saddle electrode will permit the use of prescribed gases (in terms of the nature of gases, composition, temperature, velocity, directional flow, degree of saturation, etc.) to determine the production of, trajectories, and ultimately deliver charged droplets, gas-phase ions, or combinations thereof onto distal surface, into tubes, openings, etc.

(f) Although electrospray nebulizers are high-field ionization devices that influence the trajectories of ions downstream of the nebulizer, the saddle electrode of our electrospray nebulizer prevent these fields from influencing the trajectories of ions in the field-free or near field-free region.

(g) The presence of co-axial counter and saddle electrodes will permit adding gas between the electrospray needle and the counter-electrode to assist in the nebulization the liquid and also sweep the resulting highly charged aerosol through the saddle electrode into the field-free or near-field free region.

CONCLUSION, RAMIFICATION, AND SCOPE

Accordingly, the reader will see that the field-free electrospray nebulizer of this invention can be used to introduce a highly charged aerosol and subsequently generate gas-phase ions in a field-free desolvation region from a distal source of charged aerosol or droplet generation, can be used to generate gas-phase ions in an isokinetic flow of gas, and can be use to deliver charged droplets to a surface. In addition, when a field-free electrospray nebulizer has been used to deliver charged droplets to a surface, the resulting analyte ions from the surface are produced in a field-free or near field-free region without the dispersive electric fields of a ion source impairing the ability to collect and focus these analyte ions. Furthermore, the field-free electrospray nebulizer has the additional advantages in that:

it permits the production and collection of highly charged aerosols, comprised of charged droplets and gas-phase ions, from the electrospray nebulizer to be collected in the field-free region where the charged species can focused into a small cross-section area;

it allows the volume of the field-free desolvation region to be 100's $cm^3$;

it provides an electrospray nebulizer with a field-free or near field-free desolvation and reaction chamber where species, charged, and uncharged can react producing new charged species which are detected with a gas-phase analyzer;

it provides an electrospray nebulizer with co-axial electrodes, counter and saddle electrodes, where gas can be introduced between the electrospray needle and the counter-electrode aiding in the nebuliziation of the liquid and eventual transport of the highly charged aerosol into a fireld-free or near field-free region;

it permits long residence time of the species in the field-free or near field-free desolvation region;

it allows the relative position of the electrospray nebulizer to be independent of any ion detector present;

it allows the electrospray nebulizer to be comprised of multiple nebulizers, arranged in an array;

it provides an electrospray nebulizer which can be comprised of various types of nebulizers, such as but not limited to nanospray, pneumatically assisted electrospray to be used;

it provides an electrospray nebulizer which can deposit a highly charged aerosol onto a surface, distal to the nebulizer; and it allows the electrospray nebulizer along with a field-free or near field-free desolvation region to be incorporated into a portable or benchtop chemical analyzer, the analyzer itself comprised of gases or gas inlets, electronics, gas and electronic controllers, and a gas-phase ion detector, such as but not limited to mass, ion mobility, or differential mobility spectrometers, etc;

Although the description contains many specifications, these should not be construed as limiting the scope of the invention but as merely providing illustrations of some of the presently preferred embodiments of this invention. For example, the nebulizer and field-free desolvation region can be constructed as a totally integrated or monolithic structure or as separate components which can easily be disassembled and reassembled as necessary; the position of the electrospray needle can be adjustable relative to the counter-electrode; the size of the aperture of the counter-electrode and saddle electrode can be variable, either adjusted manually or by computer control; the potentials of the electrospray needle, counter-electrode, saddle electrode, and field-free or near field-free desolvation reaction region can be adjusted manually or by computer control to obtain optimum performance; various gases may be used, such as but not limited to, nitrogen, air, helium, and mixtures thereof; the nebulizer and field-free region can be constructed of electrically conductive and insulating materials, such as but limited to composites, silica, glass, glass coated with di-electrics, metal coated insulator, stainless steel, Teflon, Vespel, composites, and combination thereof; etc.

Thus the scope of the invention should be determined by the appended claims and their legal equivalents, rather than by the examples given.

We claim:

1. A remote reagent ion generator comprising:

a. an electrospray ion source at or near atmospheric pressure, comprising an enclosure having an entry means for a gas at one end thereof, said enclosure having a first electrode disposed therein adjacent to said entry means and a counter-electrode with an opening adjacent and in close proximity to said first electrode, said is first electrode comprises a capillary or tube for receiving a liquid and said first electrode is electrically biased relative to said counter-electrode to produce an electrospray liquid jet and plume, said plume comprised of an aerosol of highly charged droplets, gas-phase ionic species, and combinations thereof;

b. a saddle-field element or electrode with an opening or aperture disposed at a location downstream and in close proximity to said counter-electrode, electrostatic potential and relative position of said element to said counter-electrode arranged to create a field-free or near field-free passage or region downstream from said element by cancelling or negating said electric potentials of said ion source required to electrospray said liquid, said potential of said element is at or near a midpoint potential between said potentials said first electrode and said counter-electrode;

c. a means for defining a field-free or near field-free sample reaction region at or near atmospheric pressure, said means located adjacent and in close proximity to said saddle-field element and separated therefrom by said passage, said passage arranged to allow said liquid jet, aerosol and ionic species to pass through; and d. a means to deliver said aerosol and gas-phase ionic species away from said ion source, through said openings and passage, and towards said reaction region;

whereby substantially all said aerosol and ion species in said passage are urged out of said passage into said reaction region.

2. The remote reagent ion generator of claim 1, wherein said means to deliver said aerosol and gas-phase ionic species is provided by a flow of gas from said ion source, a flowing stream of gas added to said passage, or combination thereof, wherein said gases are comprised of temperature controlled and metered supply of gases of a prescribed composition.

3. The remote reagent ion generator of claim 1, further including a means to introduce sample components into said reaction region; said components comprised of an aerosol of highly charged or neutral droplets, a flowing gas stream comprised of gas-phase ions or neutral gas-phase species, solids, liquids or combinations thereof on a surface; whereby said aerosol reacts with said components in said reaction region forming charged gas-phase product ions or droplets.

4. The remote reagent ion generator of claim 3, further includes an atmospheric pressure interface, electrostatic optics, electrodynamic optics, or combinations thereof, for collecting and focusing said product ions or droplets, said aerosol, and combinations thereof; away from said reaction region to be introduced into and analyzed by a mass spectrometer, an ion mobility spectrometer, a differential ion mobility spectrometer, or combinations thereof.

5. The remote reagent ion generator of claim 1, further including a plurality of ion generators coupled to said reaction region.

6. A remote reagent ion generator for surface analysis comprising:

a. an electrospray ion source comprising an enclosure having an entry means for a gas at one end thereof, said enclosure having a first electrode disposed therein adjacent said entry means, and a counter-electrode with an opening or aperture adjacent and in close proximity to said first electrode, said first electrode is comprised of a capillary or tube for receiving a liquid and is electrically biased relative to said counter-electrode to produce an electrospray liquid jet and plume, said plume comprised of an aerosol of highly charged droplets;

b. a saddle-field element or electrode with an opening or aperture disposed at a location downstream and in close proximity to said counter-electrode, electrostatic potential and position of said element arranged to create a field-free or near field-free passage downstream from said element by cancelling or negating said potentials required to produce said electrospray liquid jet and plume;

c. a means for defining a field-free reaction region, said means located adjacent said field-free passage, said passage arranged to allow said aerosol to pass through; and d. a means to deliver said aerosol away from said ion source, through said openings and passage, and towards said reaction region;

whereby substantially all said aerosol in said passage is urged out of said passage onto a surface in said reaction region, the entire process from the production of said electrospray liquid jet and plume, delivery of said aerosol through said openings of said counter-electrode and saddle-field electrode and delivery of said aerosol through said passage onto said surface, taking place at or near atmospheric pressure.

7. The remote reagent ion generator for surface analysis of claim 6, wherein said means to deliver said aerosol is provided by a flowing stream of said gas from said ion source, a flowing stream of gas added to said passage or combination thereof, wherein said gases are comprised of a temperature controlled and metered supply of gases of a prescribed composition.

8. The remote reagent ion generator for surface analysis of claim 6, where said aerosol reacts with components on said surface forming charged product droplets, gas-phase ions, or combinations thereof.

9. The remote reagent ion generator for surface analysis of claim 8, further includes an atmospheric pressure interface comprised of a tube or capillary, an array of apertures or openings, electrostatic optics, and combinations thereof, for collecting and focusing said products away from said reaction region to be introduced into and analyzed by a mass spectrometer, an ion mobility spectrometer, a differential ion mobility spectrometer, or combinations thereof; whereby said product ions are identified.

10. The remote reagent ion generator for surface analysis of claim 6, wherein said passage is comprised of a series of passages.

11. A method for the production of gas-phase charged species at or near atmospheric pressure from a liquid containing analytes, comprising:

a. providing a remote electrospray ion source that is comprised of a capillary electrode for receiving said liquid, a counter-electrode with an opening, said counter-electrode adjacent to and in close proximity to said capillary electrode and a saddle-field electrode with an opening downstream and in close proximity to said counter-electrode;

b. supplying a gaseous stream to said remote electrospray ion source;

c. setting electrostatic potential difference between said capillary and counter-electrode at a level whereby a liquid jet and an aerosol of highly charged droplets, gas-phase ions or ion clusters, and combinations thereof, are produced from said liquid;

d. setting electrostatic potential of said saddle-field electrode to cancel out or negate electric fields produced by setting said electrostatic potential difference between said capillary and counter-electrode; and e. setting the flow rate of said gaseous stream to said ion source at a sufficient level;

whereby said aerosol is urged through said openings into a downstream field-free or near field-free desolvation region, wherein said gas-phase charged species comprised of said analytes are produced.

12. The method of claim 11, wherein said product ions are focused away from said desolvation region by means of of an electrostatic potential or potentials, a flowing stream of gas added to said desolvation region, and combinations thereof, towards a collection point.

13. The method of claim 12, wherein said collection point includes an atmospheric interface comprised of an aperture, a tube or capillary, an array of apertures or openings, electrostatic optics, and combinations thereof, for introducing said product ions into a mass spectrometer, an ion mobility or a differential ion mobility spectrometer, or combinations thereof; whereby said products ions are analyzed and identified.

14. A remote reagent ion generator, at or near atmospheric pressure, for the production of a highly-charged aerosol of charged droplets, gas-phase ions and combinations thereof, from an electrospray liquid jet and plume, comprising:

a. capillary or tube for the delivery of a liquid, said capillary having a fist prescribed electrical electric DC potential, said liquid comprised of chemical entities such as neutral molecules, ionic molecules or atoms, and combinations thereof;

b. a counter-electrode with an opening or aperture, counter-electrode downstream and in close proximity to exit of said tube, having a second prescribed electrical DC potential that is less than or greater that said first potential;

c. a saddle-field electrode with an opening, disposes downstream of and in close proximity to said counter-electrode, having a third prescribed electrical DC potential, said third potential at or near a midpoint potential between said first and second prescribed potentials; and d. a means for delivering gaseous stream in a gas flow path;

whereby said gaseous stream flows over and around said capillary and through said openings in said counter-electrode and saddle-field electrode, providing sufficient urging to sweep substantially all said highly charged aerosol downstream of said saddle-field electrode into a field-free or near field-free passage or region for collection.

15. A remote ion generator of claim 14, wherein said gaseous stream is comprised of a temperature controlled metered supply of gas or gas mixtures of prescribed composition or make-up.

16. A remote ion generator of claim 14, further including a second flowing stream of gas or gases added to said passage.

17. A remote ion generator of claim 16, wherein said second flowing stream of gas added to said passage is comprised of a temperature controlled metered supply of gas or mixtures of gases saturated with a prescribed amount of water, whereby said charged droplets are maintained as droplets and swept downstream through said field-free or near field-free passage or region and collected.

18. A remote ion generator of claim 14, wherein said field-free or near field-free passage is comprised of a tube that is constructed of metal, dielectric material or combinations thereof.

19. A remote ion generator of claim 14, further including a field-free or near field-free desolvation chamber at the exit of said passage, that is maintained at or near atmospheric pressure, and wherein a means of electrostatically focusing and collecting said highly charged aerosol resides.

20. A remote ion generator of claim 19, wherein said means of focusing and collecting is comprised of applying a prescribed electrostatic potential or potentials to a lens, aperture, capillary, laminated lens populated with a plurality of openings or combinations thereof, set at a level or levels whereby, substantially all said charged droplets and gas-phase ions in said chamber are urged out of said chamber towards a collection point.

21. A remote ion generator of claim 20, further including an atmospheric pressure interface for a mass spectrometer, a reduced pressure ion mobility spectrometer or combinations thereof, or a tube or passage leading into an atmospheric pressure differential ion mobility spectrometer; at said collection point.

22. A method for remotely creating a stream of highly charged droplets at or near atmospheric pressure, comprising:

a. creating an electrospray liquid jet and plume of highly charged droplets by establishing an electric DC potential difference between a capillary supplying a liquid and a counter-electrode with an opening, said counter-electrode positioned in close proximity to said capillary;

b. providing a saddle-field electrode with an opening, downstream and in close proximity to said counter-electrode, supplied with an electrostatic potential at or near the mid-point between potentials supplied to said capillary and counter-electrode, to cancel or negate said electric DC potential difference required to electrospray said liquid, thereby creating a field-free or near field-free region, at or near atmospheric pressure, downstream of and in close proximity to said saddle-field electrode; and c. supplying a flow of gas to said plume;

whereby substantially all said droplets are urged from where they are created, through said openings, and into said proximal field-free region as said directed stream of highly charged droplets.

* * * * *